US005468354A

United States Patent [19]

Zoppi

[11] Patent Number: 5,468,354

[45] Date of Patent: Nov. 21, 1995

[54] PROCESS FOR HEAVY METAL ELECTROWINNING

[75] Inventor: Gianni Zoppi, Dino di Sonvico, Switzerland

[73] Assignee: Ecochem Aktiengesellschaft, Triesen, Liechtenstein

[21] Appl. No.: 235,914

[22] Filed: May 2, 1994

[30] Foreign Application Priority Data

May 3, 1993 [CH] Switzerland ..... 01352/93

[51] Int. Cl.[6] ..... C25C 1/08; C25C 1/16

[52] U.S. Cl. ..... 204/213; 204/117; 204/118

[58] Field of Search ..... 204/113, 117, 204/118

[56] References Cited

U.S. PATENT DOCUMENTS 3,979,265 9/1976 Fonseca ..... 204/105 R

FOREIGN PATENT DOCUMENTS 0486187 5/1992 European Pat. Off. ..... C25C 1/12
936742 8/1946 France .
2739970 3/1978 Germany ..... C25C 1/16

*Primary Examiner*—John Niebling
*Assistant Examiner*—Brendan Mee
*Attorney, Agent, or Firm*—Cushman Darby & Cushman

[57] ABSTRACT

A process for producing metals, Me, selected from zinc, nickel, cadmium and cobalt, in which the corresponding water-soluble ammino complex $Me(NH_3)_nCl_m$ is formed, and such a complex, in an aqueous solution, is submitted to electrolysis in a cell which is free of there being a separator structure between the anodic and the cathodic compartments.

3 Claims, No Drawings

PROCESS FOR HEAVY METAL ELECTROWINNING

BACKGROUND OF THE INVENTION

It is known that, in general, in the electrolysis of aqueous solutions of chlorides, at the anode chlorine is developed, and the cathodic reaction can either be the development of hydrogen with production of alkalinity, or the precipitation of the metal, according to the position the latter occupies in the series of the electrochemical potentials, according to the following reactions:
anodic reaction:

$$Cl-e \rightarrow \tfrac{1}{2}Cl_2$$

cathodic reaction:

$$Me^{+}+e+H_2O \rightarrow MeOH+\tfrac{1}{2}H_2$$

or $$Me^{+}+e \rightarrow Me$$

At acidic pH values, chlorine gas is developed.

Under neutral or alkaline pH conditions, chlorine, owing to the increase in its water solubility, causes, by dismutation, the formation of hypochlorite and other oxygen-containing compounds, such as chlorate and perchlorate.

In the case of alkali-metal chlorides at pH<4, chlorine is produced, and at higher pH value alkali-metal hypochlorites or, in the case of higher anodic potentials, alkali-metal chlorates and perchlorates are produced.

Large amounts of chemical products are manufactured by this route.

In the case of heavy metal chlorides (Cu, Co, Ni, Zn, Cd, Pb, etc.), at a relatively acidic pH, the metal is deposited at the cathode and chlorine is developed at the anode.

The anodic compartment of the cell must be kept separated from the cathodic compartment by means of a diaphragm or a membrane, and the anodic compartment should be closed in order to make it possible for pure chlorine to be collected, first of all in order to prevent so toxic a gas from getting dispersed in the environment, and, furthermore, in order to prevent chlorine from coming, by diffusion, into contact with the deposited metal, and dissolving it.

The split cell, the use of which is mandatory for this kind of process, adds a considerable complication to the electrolysis facility and, in the event when an ionic membrane is used in order to separate the compartments, it also implies a very high equipment cost.

The production of chlorine, parallel to metal production, constitutes another limitation to the application of the electrolysis of chlorides for producing metals, because it is necessary that the same process can make Use of the chlorine it produces.

This is the case, for example, in the Falconbridge process, which produces electrolytic nickel from aqueous solutions of chlorides and uses chlorine in order to oxidize the ore.

In general, according to the prior art, the electrolysis of the aqueous solutions of heavy metal chlorides did not enjoy those important industrial applications which its potentialities would deserve given the advantages it offers on energy side, due to the high conductivity of chloride solutions, and given the anodic potential of chlorine development being lower than of oxygen development.

The alternative solutions to the anodic chlorine development adopted heretofore are, e.g., the oxdiation of $Fe^{2+}$ to $Fe^{3+}$, or of $Cu^{+}$ to $Cu^{2+}$ which, by occurring at a lower potential than of chlorine development reaction, avoid the production of the latter, and offer an advantage as regards the cell voltage. An example is the clear process, according to which in the cathodic compartment Cu is deposited, and at the anode iron and copper are oxidized: these, in their turn, are used in order to oxidize chalcopyrite, converting sulphide into elemental sulphur and dissolving copper.

Another solution adopted is of using in the anodic compartment a solution of an oxyacid, e.g., sulphuric acid. In this case, in order to separate the anodic from cathodic compartment, an ionic membrane, and the anodic reaction turns into a water oxidation one:

$$H_2O-2e \rightarrow \tfrac{1}{2}O_2+2H^{+}.$$

At the anode, oxygen is developed, and $H^{+}$ ions, through the membrane, reach the cathodic compartment.

Summarizing the present state of the art of metal electro winning from chloride solutions, one may state that, in the case of chlorine production, as well as in the case of alternative anodic reaction, a cell split by a diaphragm an ionic membrane should be always used, with all of the facility complications and the higher costs involved by such a structure.

SUMMARY OF THE INVENTION

The present invention aims at producing metal by electrolysis from aqueous solutions, overcoming the drawbacks displayed by the technology known from the prior art, which are summarized above.

Such a purpose is achieved according to the present invention with a process for electrowinning metals Me, characterized in that the corresponding water-soluble ammino complex $Me(NH_3)_nCl_m$ is formed, (in which n=4 or 6, and m=2) and such a complex, in an aqueous solution, is submitted to electrolysis in a cell free from separation means between the anodic and the cathodic compartments.

Beside the simplifications as regards the equipment and the easier facility operations, the process according to the present invention makes it possible to increase current efficiency values and to reduce cell voltage, and, consequently, to attain a considerable reduction in energy consumptions per each unit of metal produced.

These considerable advantages and improvements can be obtained according to the present invention for all those heavy metal chlorides which form complexes with ammonia and which in their ionic form display a stable oxidation state within the used potential range, e.g., Zn, Co, Ni, Cd, and so forth.

To a the solution containing the chloride of the metal to be produced, ammonia and/or ammonium chloride is added in order to form an amino complex of the type $Me(NH_3)_nCl_m$, which prevents metal hydroxide precipitation.

The chloro-ammino complex is thus dissociated into $[Me(NH_3)_n]^{m+}$ and mCl.

When the thus-obtained solution is submitted to electrolysis, at the cathode the metal is deposited and ammonia is liberated from the complex; at the anode the chloride is oxidized to chlorine, but the resulting chlorine reacts in the vicinity of the same anode, with the ammonia released and migrated from the anodic region, oxidizing it to nitrogen, according to the reaction:

$$3Cl_2+2NH_3 \rightarrow N_2+6HCl$$

or $$3Cl_2+2NH_4Cl \rightarrow N_2+8HCl.$$

Thus, elemental nitrogen is developed instead of chlorine. Inasmuch as the reaction of oxidation of ammonia or ammonium ion to nitrogen displays a lower electrochemical potential than the oxidation potential of chlorides to chlorine, the anodic voltage stabilizes at a lower value than as observed in chloride electrolysis with chlorine gas development. The resulting reduction in the anodic voltage, added to the higher conductivity of chloride solutions, makes it possible for the cell voltage to be decreased, with a decrease which may be as high as 30%, as compared to the known technique of electrolysis of metal sulfates in acidic solution.

For the optimization of the voltage value, and in order to allow a high enough solubility of chloroammino complex to be achieved, the cell operating temperature should be higher than 40° C. and lower than 80° C., and preferably is 60° C.

The ammonia which is oxidized to elemental nitrogen must be replenished, and the added amount is controlled by the pH value, which should remain constant around the neutrality value.

Another feature of the process is that, with the electrolysis occurring at pH values of approximately 7, the metal deposition takes place under much more competitive potential conditions than the alternative reaction of hydrogen development, with benefits as regards current efficiency.

The decreased cell voltage and the higher current efficiency contribute to reduce energy consumption in metal refining.

Another object of the present invention is a suitable facility for implementing the above defined process, which comprises a non-split electolytic cell, e.g., one in which the anode and the cathode are not provided with separator, such as a diaphragm or a membrane, between the anodic and cathodic cell compartments.

In order to better disclose characteristics and advantages of the invention, an exemplifying, non-limitative embodiment thereof is provided in the following.

DETAILED DESCRIPTION

EXAMPLE 500 g of technical zinc oxide, having commercial purity, was dissolved in 10 of an aqueous solution with 250 g/l of $NH_4Cl$, at the temperature of 60° C.

At reaction end, with all oxide having been dissolved, 2.5 g of zinc powder was added in order to cement any impurities of Cu, Pb and Cd contained in a small amounts in the oxide.

The purified solution was then circulated at 60° C. inside a non-split electrolytic cell which contained a cathode consisting of a titanium plate between two insoluble anodes of graphite, wherein the solution was kept vigorously stirred by means of air blown under the cathode.

By causing a current of 20 A to flow with an initial voltage of 2.7 V (2.85 V under steady-state conditions) throughout a period of 10 hours, 229.6 g of pure zinc was deposited, with 40 g of $NH_3$, added as a 129 g of aqueous solution at 31%, being consumed.

The end solution had a pH value of 6.9 and contained 18.5 g/l of zinc in solution.

When the solution was recycled, it was capable of leaching 225 g of zinc oxide.

The cathodic current efficiency of the deposition was of 97.1%, and the energy consumption, limited to electrolysis, with power being supplied as direct current, was of 2.41 kWh/kg of zinc.

The consumption of $NH_3$, considered at 100%, was 17.1% by weight, relatively to the weight of obtained zinc.

As one may see from the above description, taken into consideration together with the above-reported example, the process according to the present invention makes possible a full series of considerable advantages to be achieved as compared to the prior art, according to the purposes proposed hereinabove.

I claim:

1. A process for electrowinning a metal from a complex thereof in an aqueous solution, comprising:

(a) providing a water-soluble chloro-ammino complex of a metal selected from the group consisting of zinc, nickel, cadmium and cobalt;

(b) forming an aqueous solution of said complex, having a pH in the range of about 6 to about 8; and (c) subjecting said solution to electrolysis in an electrolytic cell having an anode disposed in an anodic compartment and a cathode disposed in a cathodic compartment, while the anodic and cathodic compartments are freely intercommunicated without being separated by a diaphragm or membrane, whereby:

said metal is deposited at said cathode and ammonia is liberated and immigrates towards said anode, and chloride is oxidized to $Cl_2$ at said anode, said $Cl_2$ reacts with said ammonia, and $N_2$ is developed at said anode and restored to ammonia in said electrolyte, by controlling pH in said electrolyte to constantly be within the range of 6–8.

2. The process of claim 1, wherein:

step (a) includes reacting an oxide of said metal with ammonium chloride to generate said complex.

3. The process of claim 2, wherein:

said complex has the general formula $Me(NH_3)_nCl_2$, in which: Me is said metal, and n is 4 or 6.

* * * * *